US006364378B1

(12) United States Patent
Humbert et al.

(10) Patent No.: US 6,364,378 B1
(45) Date of Patent: Apr. 2, 2002

(54) ELECTRIC LOCK, PARTICULARLY FOR THE DOOR OF A MOTOR VEHICLE

(75) Inventors: Arnaud Humbert, Abbeville; Piotr Kruczkowski, Wanbercourt; Pierre-Henri Mouly, Lagny, all of (FR)

(73) Assignee: Valeo Securite Habitacle, Creteil, Cedex (FR)

( * ) Notice: Subject to any disclaimer, the term of this patent is extended or adjusted under 35 U.S.C. 154(b) by 0 days.

(21) Appl. No.: 09/535,306

(22) Filed: Mar. 24, 2000

(30) Foreign Application Priority Data

Mar. 24, 1999 (FR) ..... 99 03643

(51) Int. Cl.[7] ..... E05C 3/06

(52) U.S. Cl. ..... 292/201; 292/216; 292/DIG. 23; 292/DIG. 65; 70/264; 70/283.1

(58) Field of Search ..... 292/216, 201, 292/DIG. 23, DIG. 26, DIG. 3; 70/283, 283.1, 262, 264, 263, 256

(56) References Cited

U.S. PATENT DOCUMENTS 3,917,327 A * 11/1975 Plasko ..... 292/1
4,969,673 A 11/1990 Portelli et al.
5,137,312 A * 8/1992 Tang ..... 292/336.3
5,248,898 A 9/1993 Periou
5,722,272 A * 3/1998 Bridgeman et al. ..... 70/264
5,887,466 A * 3/1999 Yoshizawa ..... 70/257
6,003,910 A * 12/1999 Dupont et al. ..... 292/201
6,067,826 A * 5/2000 Holloway et al. ..... 70/278.3
6,082,158 A * 7/2000 Wegner ..... 70/277
6,102,453 A * 8/2000 Cetnar ..... 292/201

FOREIGN PATENT DOCUMENTS

| | | |
|---|---|---|
| DE | 196 32 781 | 2/1998 |
| GB | 2 313 619 | 12/1997 |
| WO | 98 33998 | 8/1998 |

OTHER PUBLICATIONS

"Electric Releasing Latch System with Remote Release and Central Child Locking for Automobiles" Research Disclosur, GB, Industrial Opportunities Ltd. Havant, No. 404, p. 933 (XP000735760 ISSN: 0374–4353).
French Search Report Dated Dec. 6, 1999.

* cited by examiner

*Primary Examiner*—Anthony Knight
*Assistant Examiner*—Vishal Patel
(74) *Attorney, Agent, or Firm*—Morgan & Finnegan, LLP

(57) ABSTRACT

A lock is disclosed for a door of a motor vehicle, which includes a locking lever for locking from the outside, and a locking lever for locking from an inside of the door, the locking lever for locking from the inside and the locking lever for locking from the outside being superposed, mounted on an articulation pin and collaborating via branches with first and second electric motors, wherein the branch associated with the first motor, belonging to one of the locking levers is shorter than the branch associated with the second motor, belonging to the other locking lever, so that a position of the first motor is offset from a position of the second motor.

12 Claims, 1 Drawing Sheet

ELECTRIC LOCK, PARTICULARLY FOR THE DOOR OF A MOTOR VEHICLE

BACKGROUND OF THE INVENTION

The present invention relates to an electric lock, particularly for the door of a motor vehicle and more specifically to a lock which is locked/unlocked electrically.

There is known a lock for the door of a motor vehicle which comprises a first electric motor capable, via a set of gears, of driving a locking lever to move a lever for opening from the outside between a locked position in which the lever for opening from the outside is inactive and an unlocked position in which the lever for opening from the outside is able to cause the lock to open, under the action of a means for opening from the outside, for example an external door handle or paddle. This lock has a second electric motor for deadlocking capable, via a second set of gears, of deadlocking the lock with respect to the external and internal door handles and with respect to the lock stalk.

However, a lock of this kind requires two completely different drivelines to be designed, one for the locking function and one for the deadlocking function. As a result, the motors have to be placed in an electrical compartment separate from the driveline compartment containing the various levers for opening and locking the lock.

BRIEF SUMMARY OF THE INVENTION

The object of the invention is to provide an electric lock in which the drivelines for locking and deadlocking are simplified.

To this end, the subject of the invention is an electric lock, particularly for the door of a motor vehicle, comprising a first electric motor for locking from the outside, capable of driving a lever for locking from the outside to move a lever for opening from the outside between a position of being locked from the outside, in which position the lever for opening from the outside is inactive and a position of being unlocked from the outside, in which position the lever for opening from the outside is able to cause the lock to open, under the action of a means for opening from the outside, and a second electric motor which allows the lock to be placed in a deadlocked position wherein said second electric motor is capable of driving a lever for locking from the inside to move a lever for opening from the inside between a position of being locked from the inside, in which position the lever for opening from the inside is inactive, and a position of being unlocked from the inside, in which position the lever for opening from the inside is able to cause the lock to open, under the action of a means for opening from the inside, it being possible for the two aforementioned motors to be powered simultaneously to deadlock the lock as far as opening from the outside and as far as opening from the inside are concerned, whereas the first electric motor can be powered by itself to lock the lock as far as opening from the outside is concerned.

In a first alternative form, in the case of a motor vehicle front door, powering the second electric motor causes the first motor to be powered at the same time.

In another alternative form, in the case of a rear door lock, the second electric motor can be powered by itself so as to child-lock the lock so that it cannot be opened from the inside.

Advantageously, the lever for locking from the inside and the lever for locking from the outside are superposed and mounted on the same articulation pin.

According to another feature, a worm gear is mounted on the drive shaft of each electric motor, each gear meshing with a toothed sector at one end of one branch of the associated locking lever.

According to another feature, the branch of one of the locking levers which bears one toothed sector is shorter than the branch of the other locking lever which bears the other toothed sector, the longer branch also exhibiting a step so that the two toothed sectors are arranged in two planes parallel to and distant from each other.

According to yet another feature, the two motors, the two locking levers and the two opening levers are housed in the same compartment of the lock casing.

Advantageously, the lever for locking from the inside has a branch which can collaborate with a boss on the lock casing, so as to define two stable positions, one on each side of said boss, by said lever for locking from the inside passing elastically over said boss.

In order to give a better understanding of the subject matter of the invention, one embodiment thereof and depicted in the appended drawing will now be described by way of purely illustrative and nonlimiting example.

DETAILED DESCRIPTION OF THE INVENTION

Figure 1:
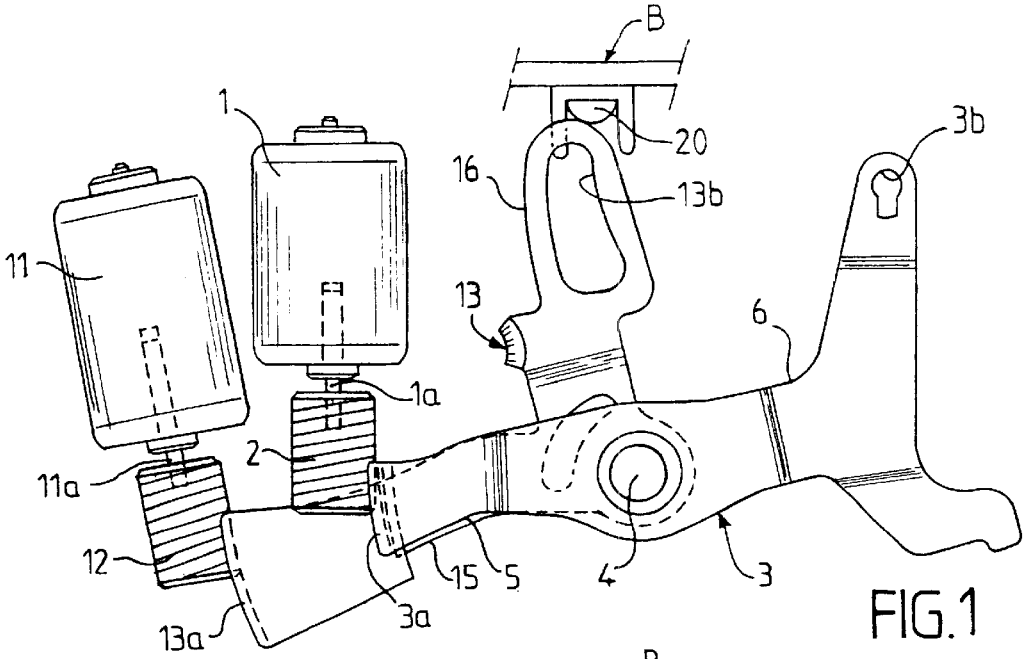
FIG. 1 is a partial view from above and in plan view of the driveline compartment of the lock casing of the invention, with the lock in the unlocked position.

The driveline compartment of the lock casing B of the invention comprises, in FIG. 1, a first electric motor 1 for locking from the outside, the driveshaft la of which rotates as one with a worm gear 2. The worm gear 2 meshes at its periphery with a toothed sector 3*a* provided at the end of one branch 5 of one lever 3 for locking from the outside. The lever 3 for locking from the outside is articulated, approximately at its center, on a rotation pin 4 and at the end of its opposite branch 6 has an opening 3*b* intended to collaborate with a lever for opening from the outside (not depicted). The lever 3 for locking from the outside is approximately T-shaped or Y-shaped.

The driveline compartment also comprises a second electric motor 11 for locking from the inside, the driveshaft 11*a* of which rotates as one with a worm gear 12. The elements 11 and 12 in their entirety may be identical to the elements 1 and 2 mentioned hereinabove.

The worm gear 12 meshes with a toothed sector 13*a* provided at the end of one branch 15 of one lever 13 for locking from the inside. The lever 13 for locking from the inside is approximately in the shape of an angle bracket, when viewed from above, and is articulated approximately at its center on the same aforementioned rotation pin 4. The opposite branch 16 of the lever 13 for locking from the inside has an oblong opening 13*b* which is intended to collaborate with a lever for opening from the inside (not depicted).

The lever for opening from the inside and the lever for opening from the outside are intended to operate a pawl located in the lock casing retaining compartment, the pawl being intended to immobilize a retaining latch of a striker fixed to an upright of the door surround. The pawl and the latch in the retaining compartment are not described in detail because they are known per se.

The casing B comprises, in the driveline compartment, a boss 20 intended to collaborate with the end of the branch 16 of the lever 13 for locking from the inside. This branch 16 of the locking lever 13 is intended, as it moves between the position of unlocking from the inside and of locking from the inside, to pass elastically over the boss 20, which defines two stable positions for the lever 13 for locking from the inside, one on each side of the boss 20.

Figure 2:
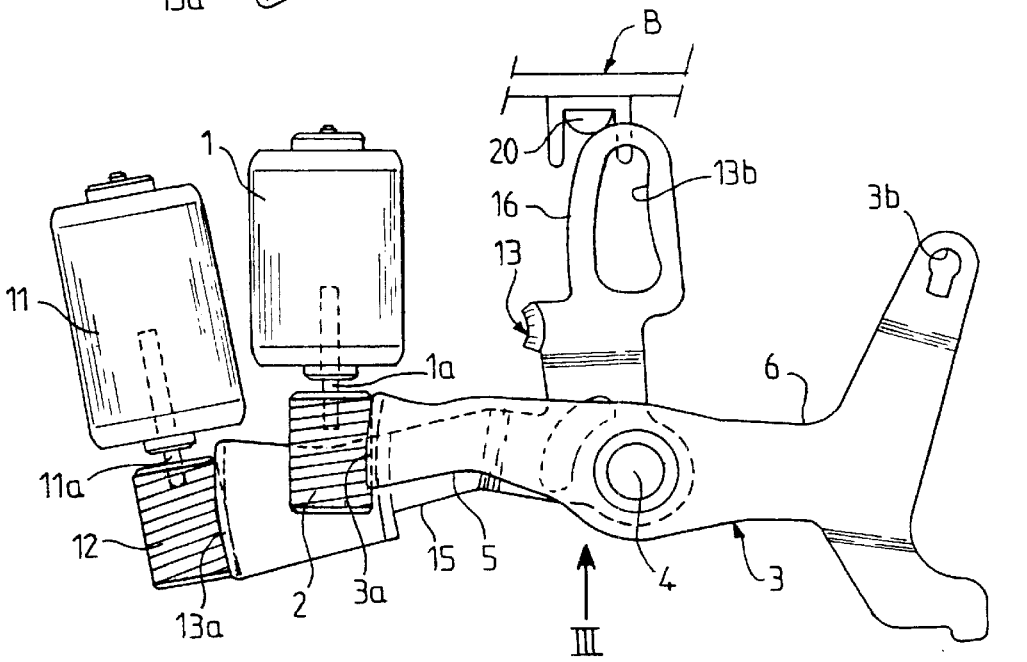
FIG. 2 is a view similar to FIG. 1, but with the lock in the deadlocked position.
Figure 3:
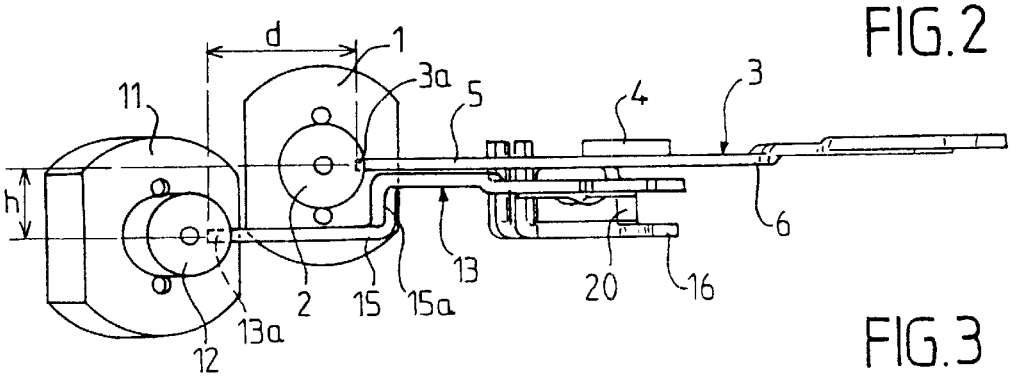
FIG. 3 is a view in side elevation in the direction of arrow III of FIG. 1.

It can be seen in FIGS. 1 to 3 that the electric motors 1, 11 and the locking levers 3, 13 in their entirety are assembled in a compact way, which limits their bulk and allows them to be housed in one and the same compartment. It is thus possible to obtain a two-compartment lock, namely a lock with one retaining compartment and one driveline and electrical compartment, instead of a lock with three compartments, namely a retaining compartment, a driveline compartment and an electrical compartment.

The branch 5 of the lever 3 for locking from the outside, which bears the toothed sector 3a, is shorter by a distance d than the branch 15 of the lever 13 for locking from the inside, which bears the toothed sector 13*a,* so that the positions of the two electric motors 1, 11 can be offset as visible in FIGS. 1 and 2. The motors 1 and 11 are also offset by a distance h in the heightwise direction, as visible in FIG. 3, so that the driving of one locking lever is not impeded by the driving of another lever. The branch 15 which bears the toothed sector 13a has a downward step 15*a,* so as not to interfere with the branch 5 of the other lever 3 positioned vertically above it.

A brief description of the way in which the lock of the invention works will now be given.

When the user wishes to lock the lock so that it cannot be opened from the outside, he electrically powers the first electric motor 1 and this has the effect of moving the lever 3 for locking from the outside into its locked position illustrated in FIG. 2. To electrically unlock the lock, the electric motor 1, which is designed to be reversible, makes the lever 3 for locking from the outside move into its position illustrated in FIG. 1.

In the case of a motor vehicle front door, there is no need to be able to lock the lock electrically from the inside and so in this case electrically powering the second electric motor 11 automatically causes the first motor 1 to be electrically powered so as to deadlock the vehicle, that is to say to lock it so that it cannot be opened either from the inside or from the outside. The deadlocked position of the lock is illustrated in FIG. 2.

By contrast, in the case of a rear door, it is desirable to be able to lock the lock only to prevent it from being opened from the inside, so as to prevent a child from inadvertently opening the door by operating the interior door handle when the vehicle is moving along. In this case, it is possible to power just the second electric motor 11, so as to move the lever 3 for locking from the inside into its locked position, which disengages the actuation of the lever for opening from the inside.

It will therefore be understood that the same motors and the same locking levers can be used on a front door lock or rear door lock, simply by providing a separate power supply for the second electric motor 11 in the case of a rear door. Of course, in the case of a rear door, it is also possible to deadlock the lock by powering both electric motors 1 and 11.

Although the invention has been described in conjunction with one particular embodiment, it is quite obvious that it is not in any way restricted thereto and that it encompasses all technical equivalents of the means described and combinations thereof where these fall within the scope of the invention.

What is claimed is:

1. A lock for a door of a motor vehicle, comprising a first electric motor for locking from an outside of the door, connected to drive a locking lever for locking from the outside to move a lever for opening from the outside between a position of being locked from the outside, in which position the lever for opening from the outside is inactive and a position being unlocked from the outside, in which position the lever for opening from the outside is able to cause the lock to open, under an action of a means for opening from the outside, and a second electric motor which allows the lock to be placed in a deadlocked position and connected to drive a locking lever for locking from an inside of the door to move a lever for opening from the inside between a position of being locked from the inside, in which position the lever for opening from the inside is inactive, and a position of being unlocked from the inside, in which position the lever for opening from the inside is able to cause the lock to open, under an action of a means for opening from the inside, it being possible for the two motors to be powered simultaneously to deadlock the lock as far as opening from the outside and as far as opening from the inside are concerned, whereas the first electric motor can be powered by itself to lock the lock as far as opening from the outside is concerned, the locking lever for locking from the inside and the locking lever for locking from the outside being superposed, mounted on an articulation pin and collaborating via branches with the first and second electric motors, wherein the branch associated with the first motor, belonging to one of the locking levers is shorter than the branch associated with the second motor, belonging to The other locking lever, so that a position of the first motor is offset from a position of the second motor.

2. A lock according to claim 1, wherein the longer branch exhibits a step so that the two branches are arranged in two planes parallel to and distant from each other, so that the driving of one looking lever is not impeded by the driving of another lever.

3. A lock according to claim 1, wherein a worm gear is mounted on a drive shaft of each electric motor, each worm gear meshing with a toothed sector at one end of a branch of one of the locking levers.

4. A lock according to claim 1, wherein the two motors, the two locking levers and the two opening levers are housed in a compartment of a lock casing.

5. A lock according to claim 1, wherein, in a case of a motor vehicle front door, powering the second electric motor causes the first motor to be powered at the same time.

6. A lock according to claim 1, wherein, in a case of a rear door lock, the second electric motor can be powered by itself so as to child-lock The lock so that it cannot be opened from the inside.

7. A lock according to claim 1, wherein the locking lever for locking from the inside has a second branch which can collaborate with a boss on a lock casing, so as to define two stable positions, one on each side of said boss, by said locking lever for locking from the inside passing elastically over said boss.

8. A lock according to claim 2, wherein a worm gear is mounted on a drive shaft of each electric motor, each worm gear meshing with a toothed sector at one end of a branch of one of the locking levers.

9. A lock according to claim 2, wherein the two motors, the two locking levers and the two opening levers are housed in a compartment of a lock casing.

10. A lock according to claim 3, wherein the two motors, the two locking levers and the two opening levers are housed in a compartment of a lock casing.

11. A lock according to claim 2, wherein the locking lever for locking from the inside has a second branch which can collaborate with a boss on a lock casing, so as to define two stable positions, one on each side of said boss, by said locking lever for locking from the inside passing elastically over said boss.

12. A lock according to claim 3, wherein the locking lever for locking from the inside has a second branch which can collaborate with a boss on a lock casing, so as to define two stable positions, one on each side of said boss, by said locking lever for locking from the inside passing elastically over said boss.

* * * * *